United States Patent [19]

Schnitzer

[11] Patent Number: 4,886,205

[45] Date of Patent: Dec. 12, 1989

[54] EASILY FEEDABLE ENVELOPE CONSTRUCTION

[75] Inventor: David H. Schnitzer, Buffalo Grove, Ill.

[73] Assignee: Uarco Incorporated, Barrington, Ill.

[21] Appl. No.: 247,716

[22] Filed: Sep. 22, 1988

[51] Int. Cl.[4] ..... B65D 27/00

[52] U.S. Cl. ..... 229/68 R; 271/2

[58] Field of Search ..... 229/68 R, 69, 73; 271/2

[56] References Cited

U.S. PATENT DOCUMENTS

| | | | |
|---|---|---|---|
| 3,160,293 | 12/1964 | Hennequin | 271/2 |
| 3,227,360 | 1/1966 | Krueger | 229/73 |
| 3,450,307 | 6/1969 | Sutton | 271/2 |
| 3,531,046 | 9/1970 | Carrigan | 229/73 |
| 3,580,488 | 5/1971 | Komen | 229/69 |
| 4,148,430 | 4/1979 | Drake | 229/73 |

FOREIGN PATENT DOCUMENTS

| | | | |
|---|---|---|---|
| 921378 | 3/1963 | United Kingdom | 229/69 |

*Primary Examiner*—Stephen P. Garbe

*Attorney, Agent, or Firm*—Wood, Dalton, Phillips Mason & Rowe

[57] ABSTRACT

An envelope construction including a pair of superimposed sheets 10, 12 having aligned opposed side edges 14, 16, a third edge 18 of one of the sheets 10 extending between the side edges 14, 16 being enlarged in comparison to the third edge 20 of the other sheet 12 and carrying an adhesive 24 to define a sealable flap 22 for the envelope. A U-shaped glue pattern 28 secures the sheets 10 and 12 together and the bight 32 of the U-shaped pattern is spaced from the third edges 18 and 20 as well as from a fourth edge 34 to define an envelope pocket as well as an envelope extension 36 between the bight 32 and the fourth edge 34. The extension 36 aids in the prevention of hang-up when the envelope is being fed, bottom first, into a stack of envelopes.

9 Claims, 1 Drawing Sheet

Fig 1
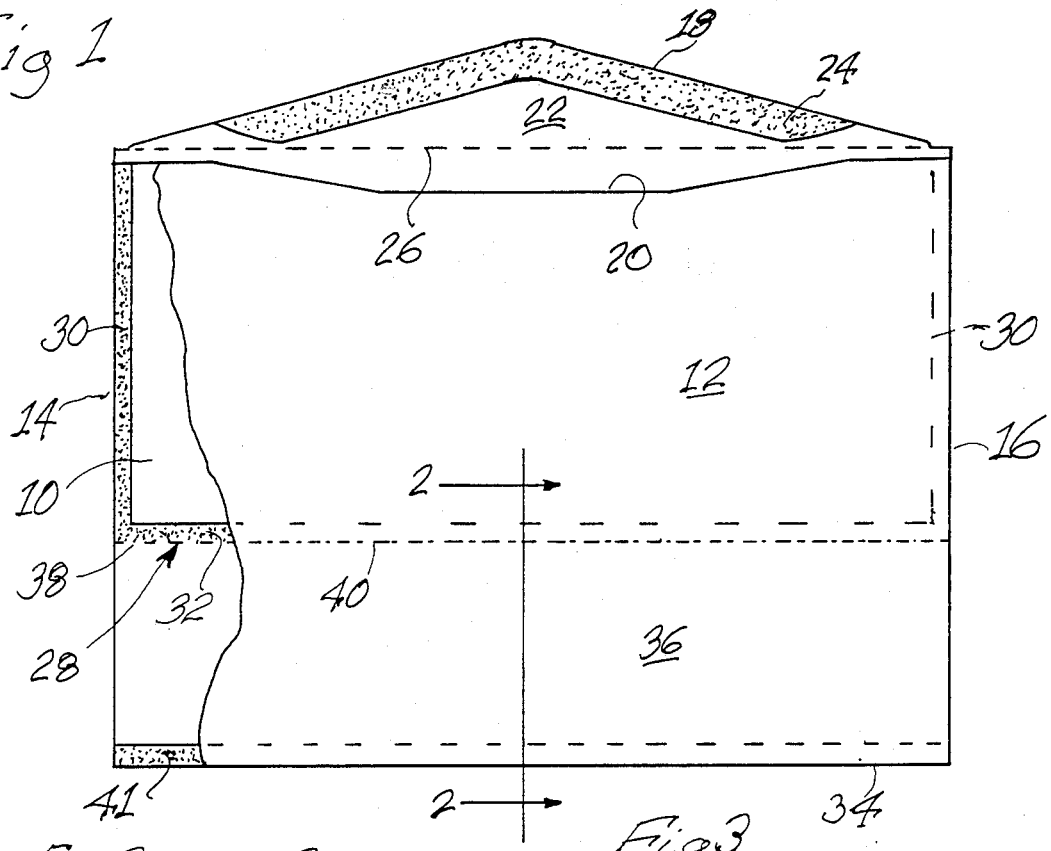
Fig2
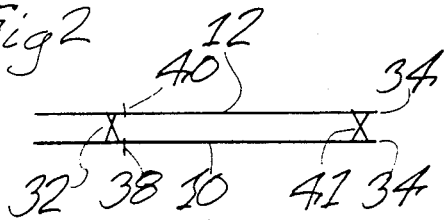
Fig3
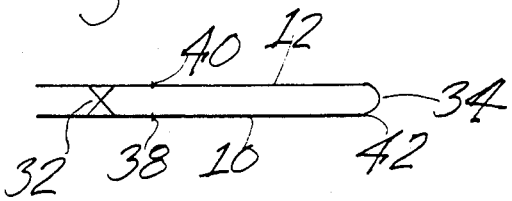
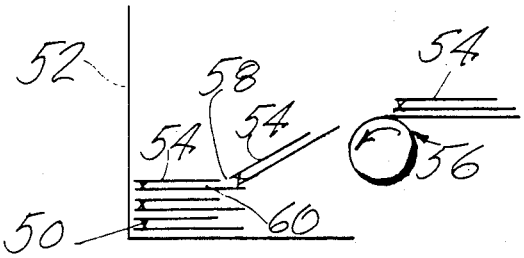
Fig 4 PRIOR ART
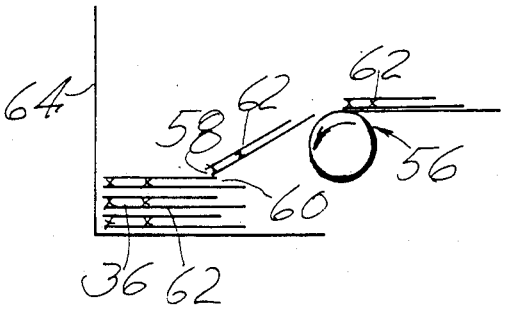
Fig 5

EASILY FEEDABLE ENVELOPE CONSTRUCTION

FIELD OF THE INVENTION

This invention relates to envelope constructions, and more particularly, to envelope constructions that are designed for feeding into stacks without hanging up on a subjacent envelope in the stack.

BACKGROUND OF THE INVENTION

Increased efficiency of mailing operations of all sorts has necessitated reliance upon a variety of machines which conduct various parts of the mailing operation. Such machines have been developed for stuffing materials into envelopes. Machines have been developed for addressing envelopes. Machines have been developed for closing and sealing envelopes, and the list goes on.

As a consequence, fully automated mailing systems can be made and the same work extremely well. However, there occasionally occurs a hang-up in the system as, when one piece of mail catches on another piece of mail or on a part of the machinery employed in the system.

By way of example, many systems in use today employ a Model 9700 printer manufactured by the Xerox Corporation. The printer may be utilized in the addressing of envelopes. Conventional business size envelopes with normal non linear contoured flaps are too short to feed through these printers and will jam in various places. In an effort to avoid this particular problem, some prior art proposals utilize an ultra wide envelope assembly having an enlarged flap. That is to say, the size of the flap is on the order of the same size as the body of the remainder of the envelope.

This type of construction feeds relatively easily but introduces new difficulties. For one, in outfeeding these printed envelopes, they are fed to a stack and the arrangement is such that there is a possibility that an envelope being fed to the stack will hang up on the subjacent envelope in the stack. Frequently, the hang-up may be caused by the bottom edge of this elongated flap envelope being caught in the opening to the envelope pocket of the subjacent envelope in the stack.

When such occurs, manual operator intervention to straighten the stack and clear the proceeding sections of the printer is required; and such defeats the purpose of automation.

Secondly, the nature of this construction is such that it does not have the appearance of a conventional envelope and thus does not appear to be individualized as might be desired.

Thirdly, and perhaps more importantly, in designing the an envelope with an elongated flap, the prior art has provided an envelope that is not readily capable of being stuffed and sealed in most automatic equipment.

The present invention is directed to overcoming one or more of the above problems.

SUMMARY OF THE INVENTION

It is the principal object of the invention to provide a new and improved envelope construction. More specifically, it is an object of the invention to provide such an envelope construction that can be fed into a stack without hanging up on the subjacent envelope or envelopes in the stack. It is also an object of the invention to provide such an envelope construction that appears like a conventional envelope and which can be readily stuffed on automatic stuffing equipment and subsequently sealed.

An exemplary embodiment of the invention achieves the foregoing object in a structure including means defining the front and back of an envelope having first and second aligned, opposed side edges. A foldable flap is disposed at a third edge of the front of the envelope and is movable to a position overlying the third edge of the back. Adhesive is provided for sealing the flap to the back.

Means including a glue line intermediate the third edges and a fourth edge secure the front and back together to thereby form a sealable pocket opening to the third edges as well as an envelope extension between the glue line and the fourth edge. A line of perforation is disposed in the front and the back between the fourth edge and the glue line. The line of perforation is adjacent the glue line and is generally parallel thereto.

The extra length from top to bottom of the envelope permits the same to be fed bottom first to a stack without hanging up. Yet, when the processing of the envelope is virtually complete, the extension can be removed along the line of perforation to provide an envelope construction having the appearance of a conventional business envelope.

In one embodiment, the fourth edge is defined by a fold in a piece of paper which in turn constitutes a front and back defining means.

In another embodiment, the front and back defining means are defined by two separate, superimposed sheets of paper.

The invention contemplates that the glue line be the bight of a generally U-shaped glue pattern. The legs of the pattern secure the front and back together along respective ones of the first and second edges and terminate adjacent the third edge.

In a highly preferred embodiment of the invention, the total top to bottom dimension of the envelope (from the tip of the flap to the opposite edge of the extension) is on the order of 8½ inches and the distance between the fourth edge of the envelope and the glue line is on the order of two to two and one-half inches.

Other objects and advantages will become apparent from the following specification taken in connection with the accompanying drawings.

DESCRIPTION OF THE DRAWINGS

FIG. 1 is an elevation of an envelope made according to the invention with part of one side broken away for clarity;

FIG. 2 is a somewhat schematic, sectional view taken approximately along the line 2—2 in FIG. 1;

FIG. 3 is a view similar to FIG. 2 but of a modified embodiment of the invention;

FIG. 4 schematically illustrates the typical problem with prior art envelopes hanging up during feeding into a stack; and FIG. 5 schematically illustrates the results of feeding an envelope made according to the invention.

DESCRIPTION OF THE PREFERRED EMBODIMENTS

Exemplary embodiments of an envelope construction made according to the invention are illustrated in FIGS. 1–3 and with reference to FIG. 1 are seen to include an envelope front 10 and an envelope back 12. Typically, both the front 10 and the back 12 will be formed of paper or the like. The two have aligned first edges 14

(only the edge 14 of the front 10 is shown) and opposed, aligned second side edges 16. Interconnecting the side edges 14 and 16 are third edges 18 and 20 on the front and back 10 and 12 respectively. The third edge 18 on the front 10 is non-linear and may be generally in the form of a truncated triangle to define an envelope flap 22. Alternatively the third edge 18 may be straight (not shown) to define a rectangular flap (also not shown) if desired. The backside of the front 10 carries moistenable adhesive 24 whereby the flap 22 may be folded on a fold line 26 to overlie the third edge 20 of the back 12 of the envelope.

The edge 20 may also be non-linear. As shown in FIG. 1, the same is somewhat concave to facilitate entry into the interior of the envelope. When the flap 22 and the edge 20 are configured as illustrated in FIG. 1, the configuration but for the type of envelope on which it is employed would otherwise be regarded as conventional. The envelope is readily susceptible to being stuffed on automatic stuffing equipment as well as being automatically sealed. That is to say, the illustrated configuration facilitates entry into the interior of the envelope to the extent that automatic stuffing equipment may be employed.

The front and back 10 and 12 are secured to each other by a U-shaped glue pattern 28. Legs 30 of the glue pattern 28 are closely adjacent to respective side edges 14 and 16 and terminate adjacent the third edges 18 and 20. The legs 30 are interconnected by a bight 32 which is located intermediate the edges 18 and 20 on the one hand and an opposite fourth edge 34 on the other. The bight 32 along with the legs 30 thus define an envelope pocket between the front 10 and back 12 which opens to the edges 18 and 20. Preferably, the legs 30 will be sufficiently spaced from each other and the bight 32 sufficiently spaced from the fold line 26 that such pocket will have the size and shape of a conventional business size envelope.

As mentioned above, the bight 32 is intermediate the edges 18 and 20 on the one hand and the edge 34 on the other. This leaves the bottom of the envelope with an extension 36 defined by that portion of the front and back 10 and 12 between the bight 32 and the edge 34. This extension 36 aids in feeding as will be seen.

After the envelope has been processed, it is desirable to remove the extension 36 so that the remainder of the envelope appears as a conventional business envelope. To this end, both the front 10 and back 12 are provided with aligned lines of perforation 38 and 40 respectively. The lines of perforation 38 and 40 are closely adjacent to the bight 32 and generally parallel thereto. As a consequence, the extension 36 may be separated from the remainder of the envelope by bursting it free along the lines of perforation 38 and 40.

As seen in FIG. 2, the envelope may be made up of two superimposed sheets of paper to define the front 10 and back 12 of the envelope. In this case, both the front 10 and the back 12 will have separate, but generally aligned fourth edges 34, which are interconnected by a glue line 41 closely adjacent the edges 34. The glue line 41 prevents the front 10 and back 12 from separating in the area of the edges 34, which in turn, could cause feeding difficulties.

Alternatively, and as illustrated in FIG. 3, the front and back of the envelope can be defined by a single sheet folded upon itself. Thus, the fourth edge 34 is defined by a fold 42 and the glue line 41 is omitted.

FIG. 4 illustrates in somewhat schematic form the problems encountered in the feeding of envelopes with an enlarged flap, that is, envelopes without the bottom extension 36. A stack 50 of envelopes is shown in a hopper 52. Individual envelopes 54 are being fed by a feeder, schematically illustrated at 56 onto the stack 50. As can be seen, the bottom edge 58 of one envelope 54 is hanging up in the pocket opening 60 of the subjacent envelope 54 in the stack 50. In other instances, where the envelopes are fed with the front up, the same sort of hang up may occur when the bottom of an envelope encounters the flap of the subjacent envelope in the stack.

The problem is avoided in the use of envelopes made according to the invention. As seen in FIG. 5, the presence of the extensions 36 in a stack 62 of envelopes in a hopper 64 moves the pocket opening 60 a sufficient distance away from the hopper 64 such that the bottom edge 58 of the envelope 62 being fed encounters a planar part of the back 12 and thus will slide relatively freely until stopped by the hopper 64.

The extension 36 may be made of sufficient size to suit any particular piece of processing equipment. Specifically, when intended for use with a model 9700 printer, the top to bottom dimension of the extension (the distance between the line of perforation 40 and the edge 34) will be on the order of two to two and one-half inches and the overall top to bottom dimension of the entire envelope will be 8½ inches. At the same time, the ease of removal of the extension 36 provides for a conventionally appearing business envelope when finally in the hands of the ultimate recipient.

Another advantage appears to accompany use of the inventive envelope. In particular, apparently because of the ease with which it may be fed, two sided imaging where desired appears to be accomplishable more readily than with prior art constructions.

I claim:

1. An envelope construction designed for feeding into stacks without hanging up on a subjacent envelope in the stack comprising:

a pair of superimposed sheets of paper or the like and having aligned opposed side edges;

a third edge of one of said sheets extending between said side edges being enlarged in comparison to the third edge of the other sheet and carrying an adhesive to define a sealable flap for the envelope;

a U-shaped pattern of adhesive securing said sheets together, the legs of said U-shaped pattern being closely adjacent respective ones of said side edges and terminating near said third edge, the bight of said U-shaped pattern being spaced from said third edge and from a fourth edge of said sheets so as to define an envelope pocket opening at said third edges, and an envelope extension extending approximately from said bight to said fourth edge; and a line of perforation in said extension closely adjacent and generally parallel to said bight whereby said extension may be removed from the envelope after feeding and before mailing, the distance between said line of perforation and fourth edge being at least one inch.

2. The envelope of claim 1 wherein said superimposed sheets are separate sheets and have their fourth edges in alignment with each other.

3. The envelope of claim 1 wherein said superimposed sheets are formed from a single ply and said fourth edge is defined by a fold in said ply.

4. The envelope of claim 1 wherein the distance between said bight and said fourth edge is at least two inches.

5. An envelope construction adapted for feeding into stacks without hanging up on the subjacent envelope in the stack comprising:

means defining the front and back of an envelope having aligned, opposed first and second side edges;

a foldable flap at a third edge of the front and movable to a position overlying the third edge of the back;

adhesive for sealing said flap to said back;

means including a glue line intermediate said third edges and a fourth edge securing said front and back together to thereby form a sealable pocket opening to said third edges and an envelope extension between said glue line and said fourth edge; and a line of perforation in said front and said back between said fourth edge and said glue line, said line or perforation being adjacent said glue line and generally parallel thereto, the distance between said line of perforation and said fourth edge being at least one inch.

6. The envelope of claim 5 wherein said fourth edge is defined by a fold in a piece of paper which in turn constitutes said defining means.

7. The envelope of claim 6 wherein said glue line is the bight of a generally U-shaped glue pattern, the legs of said pattern securing the front and back together along respective ones of said first and second edges.

8. An envelope construction designed for feeding into stacks without hanging up on a subjacent envelope in the stack comprising:

a pair of superimposed sheets of paper or the like and having aligned opposed side edges;

a third edge of one of said sheets extending between said side edges being enlarged in comparison to the third edge of the other sheet and carrying an adhesive to define a sealable flap for the envelope;

a U-shaped pattern of adhesive securing said sheets together, the legs of said U-shaped pattern being closely adjacent respective ones of said side edges and terminating near said third edge, the bight of said U-shaped pattern being spaced from said third edge and from a fourth edge of said sheets so as to define an envelope pocket opening at said third edges, and an envelope extension extending approximately from said bight to said fourth edge; and a line of perforation in said extension closely adjacent and generally parallel to said bight whereby said extension may be removed from the envelope after feeding and before mailing, said envelope extension being imperforate between said line of perforation in said extension and said fourth edge.

9. An envelope construction adapted for feeding into stacks without hanging up on the subjacent envelope in the stack comprising:

means defining the front and back of an envelope having aligned, opposed first and second side edges;

a foldable flap at a third edge of the front and movable to a position overlying the third edge of the back;

adhesive for sealing said flap to said back;

means including a glue line intermediate said third edges and a fourth edge securing said front and back together to thereby form a sealable pocket opening to said third edges and an envelope extension between said glue line and said fourth edge; and a line of perforation in said front and said back between said fourth edge and said glue line, said line of perforation being adjacent said glue line and generally parallel thereto, said envelope extension being imperforate between said line of perforation and said fourth edge.

* * * * *